US007862350B2

(12) United States Patent
Richter et al.

(10) Patent No.: US 7,862,350 B2
(45) Date of Patent: Jan. 4, 2011

(54) COMBINATION DEVICE INCLUDING A GUIDE LIGHT AND AN ELECTRICAL COMPONENT

(75) Inventors: James Richter, Bethpage, NY (US); Edward Bazayev, Kew Gardens, NY (US); Marc Noest, Westbury, NY (US); Roger M. Bradley, North Bellmore, NY (US); Donald J. Hendler, Brookville, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 0 days.

(21) Appl. No.: 11/841,624

(22) Filed: Aug. 20, 2007

(65) Prior Publication Data

US 2009/0052162 A1 Feb. 26, 2009

(51) Int. Cl.
*H01R 13/648* (2006.01)

(52) U.S. Cl. ..... 439/107; 362/95

(58) Field of Classification Search ..... 439/107, 439/535; 362/95

See application file for complete search history.

(56) References Cited

U.S. PATENT DOCUMENTS

| | | | |
|---|---|---|---|
| D65,877 | S | 10/1924 | Vandergaw et al. |
| RE19,092 | E | 7/1932 | Despard |
| 1,875,224 | A | 7/1932 | Despard |
| 2,134,696 | A | 11/1938 | Bigman |
| 2,246,613 | A | 6/1941 | Bigman |
| 2,434,065 | A | 1/1948 | Courtney |
| 2,494,560 | A | 1/1950 | Henry |
| 2,512,975 | A | 6/1950 | Sherrard |
| 2,612,597 | A | 9/1952 | Sherrard |
| 2,740,873 | A | 4/1956 | Cronk |

(Continued)

FOREIGN PATENT DOCUMENTS

| | | |
|---|---|---|
| EP | EP0411388 | 2/1991 |

(Continued)

OTHER PUBLICATIONS

Catalog: *L-100 Leviton Wiring Device Catalog*; (date: Jan. 30, 2006); 25 pages.

(Continued)

*Primary Examiner*—Ross N Gushi
(74) *Attorney, Agent, or Firm*—Collard & Roe, P.C.

(57) ABSTRACT

There is disclosed a combination electrical device comprising a housing wherein there can be at least one light and at least one sensor disposed in the housing. The light serves as a guide light wherein the sensor is for determining the presence or absence of light. Inside the housing can be face terminals which extend up to a user accessible interface in the form of apertures for receiving prongs of a plug. The housing can include an additional housing for receiving a circuit board coupled to the light and the sensor. In addition, there can be a translucent cover for covering the light and the sensor. In at least one embodiment, the translucent cover can extend along at least one fourth of a length of a front face of the housing. In another embodiment, the translucent cover can extend along at least one third of a length of a front face of the housing. In still another embodiment, the translucent cover can extend along one half of a length of the housing.

33 Claims, 15 Drawing Sheets

U.S. PATENT DOCUMENTS

| | | | | |
|---|---|---|---|---|
| 3,204,807 | A | 9/1965 | Ramsing | |
| 3,265,888 | A | 8/1966 | Adolphson, Jr | |
| 3,435,169 | A | 3/1969 | Bienwald | |
| D220,795 | S | 5/1971 | Slater | |
| 3,588,489 | A * | 6/1971 | Gaines | 362/95 |
| 3,739,226 | A | 6/1973 | Seiter et al. | |
| 3,746,877 | A | 7/1973 | Seiter et al. | |
| 3,895,225 | A | 7/1975 | Prior | |
| 4,418,979 | A | 12/1983 | Takashima | |
| 4,514,789 | A | 4/1985 | Jester | |
| 4,522,455 | A | 6/1985 | Johnson | |
| 4,546,419 | A | 10/1985 | Johnson | |
| 4,667,073 | A | 5/1987 | Osika | |
| 4,755,913 | A | 7/1988 | Sleveland | |
| 4,774,641 | A | 9/1988 | Rice | |
| D342,581 | S | 12/1993 | Reynolds | |
| D359,346 | S | 6/1995 | Martin | |
| 5,473,517 | A | 12/1995 | Blackman | |
| D366,339 | S | 1/1996 | Waller | |
| 5,485,356 | A | 1/1996 | Nguyen | |
| 5,696,350 | A | 12/1997 | Anker | |
| D397,812 | S | 9/1998 | Schifrin | |
| 5,833,350 | A | 11/1998 | Moreland | |
| 5,934,451 | A | 8/1999 | Yu et al. | |
| D413,862 | S | 9/1999 | Huang et al. | |
| 6,000,807 | A | 12/1999 | Moreland | |
| 6,005,189 | A | 12/1999 | Anker | |
| 6,045,232 | A | 4/2000 | Buckmaster | |
| 6,078,113 | A | 6/2000 | True et al. | |
| D427,887 | S | 7/2000 | Leopold et al. | |
| 6,089,893 | A | 7/2000 | Yu et al. | |
| 6,350,039 | B1 | 2/2002 | Lee | |
| 6,386,725 | B1 | 5/2002 | Amburgey | |
| 6,421,941 | B1 | 7/2002 | Finke et al. | |
| 6,433,555 | B1 | 8/2002 | Leopold et al. | |
| 6,437,700 | B1 | 8/2002 | Herzfeld et al. | |
| D468,033 | S | 12/2002 | Warren et al. | |
| 6,547,411 | B1 * | 4/2003 | Dornbusch | 362/95 |
| 6,593,530 | B2 | 7/2003 | Hunt | |
| 6,765,149 | B1 | 7/2004 | Ku | |
| 6,796,690 | B2 | 9/2004 | Bohlander | |
| 6,805,469 | B1 * | 10/2004 | Barton | 362/365 |
| 6,808,283 | B2 | 10/2004 | Tsao | |
| 6,827,602 | B2 | 12/2004 | Greene et al. | |
| 6,883,927 | B2 * | 4/2005 | Cunningham et al. | 362/95 |
| D505,395 | S | 5/2005 | Fort et al. | |
| 6,888,323 | B1 | 5/2005 | Null et al. | |
| 6,929,376 | B2 | 8/2005 | Harris | |
| 6,962,505 | B1 | 11/2005 | Savicki, Jr. et al. | |
| 6,986,589 | B2 | 1/2006 | Evans et al. | |
| D515,448 | S | 2/2006 | Nelson et al. | |
| D515,449 | S | 2/2006 | Nelson et al. | |
| D515,959 | S | 2/2006 | Nelson et al. | |
| D515,960 | S | 2/2006 | Nelson et al. | |
| 7,036,948 | B1 | 5/2006 | Wyatt | |
| 7,045,975 | B2 | 5/2006 | Evans | |
| 7,049,910 | B2 | 5/2006 | Campolo et al. | |
| 7,118,235 | B2 | 10/2006 | Barton | |
| D534,873 | S | 1/2007 | Merritt et al. | |
| D535,627 | S | 1/2007 | Merritt et al. | |
| 7,165,864 | B2 | 1/2007 | Miller | |
| D542,230 | S | 5/2007 | Merritt et al. | |
| D543,159 | S | 5/2007 | Merritt et al. | |
| 7,213,932 | B1 * | 5/2007 | Savicki, Jr. | 362/95 |
| 7,234,844 | B2 | 6/2007 | Bolta et al. | |
| D553,102 | S | 10/2007 | Merritt et al. | |
| 7,285,723 | B2 | 10/2007 | Lindenstraus et al. | |
| 7,312,394 | B1 | 12/2007 | Weeks et al. | |
| D564,129 | S | 3/2008 | Tufano et al. | |
| 7,360,912 | B1 * | 4/2008 | Savicki, Jr. | 362/95 |
| 7,416,310 | B1 | 8/2008 | Savicki, Jr. | |
| 7,586,718 | B1 | 9/2009 | Radosavljevic et al. | |
| D603,983 | S | 11/2009 | Richter et al. | |
| D603,984 | S | 11/2009 | Richter et al. | |
| D603,985 | S | 11/2009 | Richter et al. | |
| D604,873 | S | 11/2009 | Richter et al. | |
| 2002/0172042 | A1 | 11/2002 | Wen-Chung | |
| 2003/0092297 | A1 * | 5/2003 | Reindle et al. | 439/107 |
| 2003/0102944 | A1 * | 6/2003 | Leopold et al. | 335/18 |
| 2005/0012633 | A1 | 1/2005 | Yoon | |
| 2005/0152128 | A1 | 7/2005 | Campman | |
| 2007/0026701 | A1 | 2/2007 | Kurek et al. | |
| 2007/0171625 | A1 | 7/2007 | Glazner | |
| 2007/0183160 | A1 | 8/2007 | Tufano et al. | |
| 2007/0193866 | A1 | 8/2007 | Eder et al. | |
| 2007/0251712 | A1 | 11/2007 | Berg et al. | |
| 2007/0291469 | A1 * | 12/2007 | Chen | 362/95 |
| 2008/0073117 | A1 | 3/2008 | Misener | |
| 2009/0032278 | A1 | 2/2009 | Weeks et al. | |
| 2009/0035967 | A1 | 2/2009 | Weeks et al. | |
| 2009/0052162 | A1 | 2/2009 | Richter et al. | |
| 2009/0141477 | A1 | 6/2009 | Bhosale et al. | |

FOREIGN PATENT DOCUMENTS

| | | |
|---|---|---|
| JP | 2005-116252 | 4/2005 |
| JP | 2005-183319 | 7/2005 |
| KR | 10-2005-0119842 | 12/2005 |

OTHER PUBLICATIONS

Table of Contents 2 pages.

International Search Report and Written Opinion of the International Searching Authority, mailed on Feb. 27, 2009 for PCT/US2008/073098 which was filed on Aug. 14, 2008.

International Search Report and Written Opinion of the International Searching Authority, mailed on Feb. 27, 2009 for PCT/US2008/073098 which was filed on Aug. 14, 2008.

Pass and Seymour Legrand Advertisement, Copyright 2004.

U.S. Appl. No. 29/367,882 filed on Aug. 13, 2010 Titled Wiring Device with Illimination.

U.S. Appl. No. 12/856,387 filed on Aug. 13, 2010 Titled Wiring Device with Illumination.

* cited by examiner

COMBINATION DEVICE INCLUDING A GUIDE LIGHT AND AN ELECTRICAL COMPONENT

BACKGROUND OF THE INVENTION

The invention relates to a combination device including a guide light and an additional electrical component. The combination device can be disposed in a housing which can be mounted in a wall mounted electrical enclosure. Previously, because of limited space in the housing, the addition of a light would result in a reduced availability or functionality of the electrical component such as requiring that the light be placed in place of an electrical component such as a receptacle unit in the housing. This type device can use LEDs or Light Emitting Diodes which can be housed inside of the housing. LEDs can be surface mounted on a board and then be used to provide sufficient ambient light for a nightlight.

Some patents which relate to LED lighting include U.S. Pat. No. 7,165,864 to Miller which issued on Jan. 23, 2007 and U.S. Pat. No. 7,234,844 to Bolta et al which issued on Jun. 26, 2007, wherein the disclosures of these patents are hereby incorporated herein by reference. It is noted from the '864 patent to Miller that the Uniform Code for Buildings requires buildings and parking garages to have lights in corridors and stairwells to have an illuminance of at least one foot candle.

SUMMARY OF THE INVENTION

At least one embodiment relates to a combination electrical device comprising at least one light and at least one sensor along with an electrical component disposed in housing. In this embodiment, the arrangement of the light, the sensor and the housing are such that it does not restrict the availability of the electrical component which in at least one embodiment can be a duplex set of electrical components such as a duplex receptacle unit. In many cases, a duplex set of electrical components or a duplex user interface are positioned in a stacked manner with one electrical component such as a receptacle unit being positioned above another electrical component such as a receptacle unit. Any other electrical components can also be used in place of the receptacle units, such as switches.

Duplex receptacle units are designed to receive at least two plugs. In at least one embodiment, the electrical component can also comprise a GFCI receptacle also capable of receiving at least two plugs. In another alternative embodiment, the electrical component can be in the form of a light switch alone or a switch in combination with a receptacle unit.

In one embodiment, the housing is designed to receive a light, a light sensor and a circuit board so that it does not restrict access to an electrical component or reduce the number of electrical components disposed inside of the housing. For example, this housing can include at least one additional housing for receiving the light and sensor or the light and the sensor coupled to a circuit board. In one embodiment, the light is a LED light that serves as a guide light. In alternative embodiments, multiple lights can be disposed in the housing as well. The sensor is in communication with the light and determines the presence or absence of light. The sensor can selectively turn the light on or off depending on the presence or absence of a predetermined amount of ambient light.

In addition, in one embodiment, there is a translucent cover for covering the light and the sensor. In at least one embodiment, the translucent cover extends along at least one fourth of a length of a front face of the housing. In another embodiment, the translucent cover extends along at least one third of a length of a front face of the housing. In still another embodiment, the translucent cover extends along one half of a length of the front face of the housing. Because of the unique redesign of the housing and the receptacle terminals, the light can be placed along side the duplex receptacle openings rather than in place of a full receptacle unit.

In at least one embodiment, there can be at least one light pipe having a first end and a second end. The first end is coupled to the translucent cover, and the second end is coupled to a LED light on the second circuit board. In one embodiment, this second circuit board can includes an array of lights such as LED lights extending underneath the translucent cover.

In at least one embodiment, there are multiple translucent covers coupled to the housing. Each cover can be used to cover a single elongated light or multiple lights disposed beneath the cover.

In at least one embodiment, the sensor comprises a photoresistor which is in communication with a transistor to form a selective switch, to selectively turn on or off LED lights based upon an amount of light received by the photoresistor.

In at least one other embodiment, the sensor comprises a photo transistor which is in communication with a transistor to form a selective switch, to selectively turn on or off lights such as LED lights based upon the amount of light received by the photo transistor.

One of the benefits of this design is that the light can be incorporated within the enclosure without replacing or limiting any of the components normally disposed within the enclosure. For example, even after combining the light, the sensor and the electrical component in the form of a GFCI receptacle, there is still room for at least two user accessible interfaces in the housing, such as two different receptacles, with each one for receiving a plug, thus forming a GFCI duplex receptacle unit having a guide light.

Another benefit of this design is that it can be formed with modular components so that these components can be inserted into a housing disposed inside of the main housing to create an easily incorporated light in the device. With this modular design, the remaining components such as any remaining GFCI circuitry or components would not have to be significantly modified to add this light.

In at least one embodiment, the device is designed to emit at least one foot candle of illuminance.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
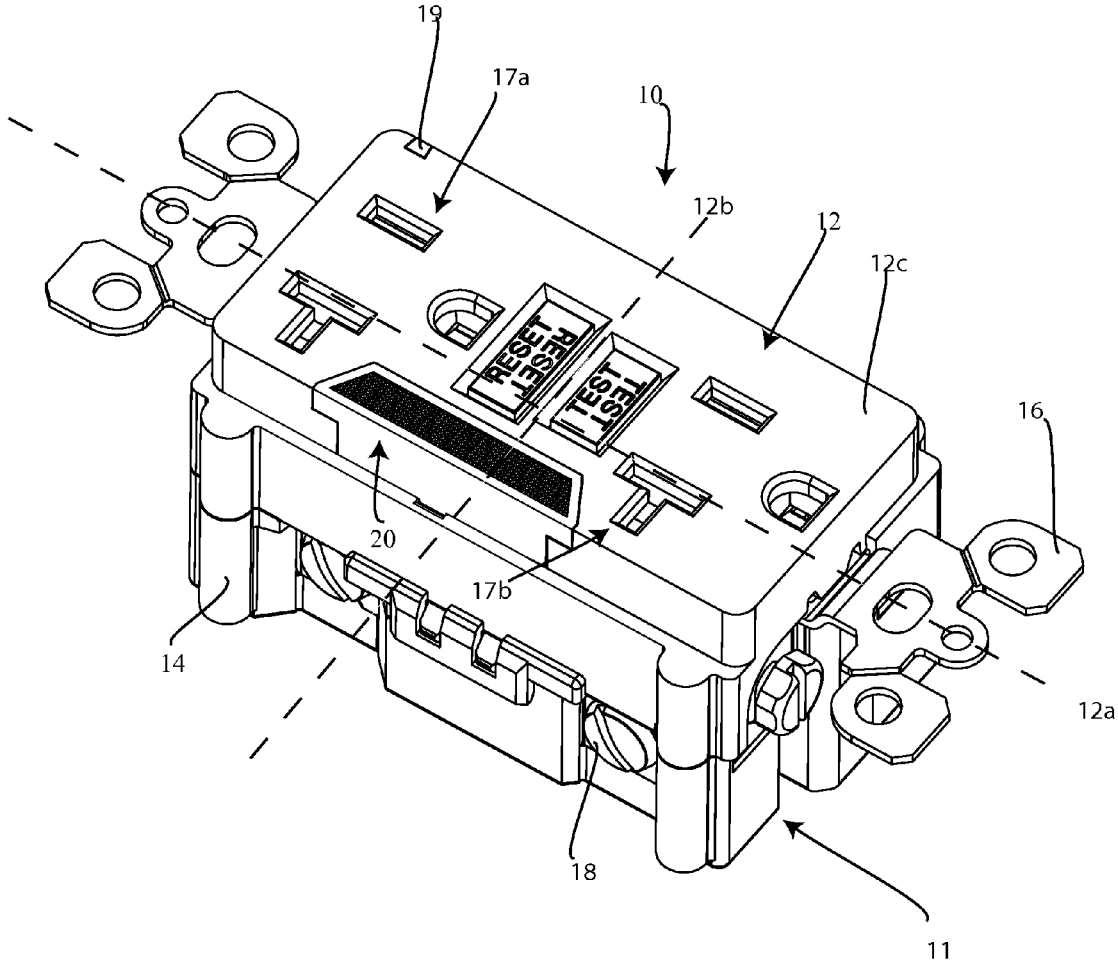
FIG. 1 is a perspective view of a first embodiment of the invention.

Referring in detail to the drawings, FIG. 1 discloses a perspective view of a combination device 10 in the form of an electrical component comprising a ground fault circuit interrupter (GFCI) having an additional guide light. Device 10 has a housing 11 formed by a front cover 12 coupled to body section 14. Front cover 12 has a length extending along a longitudinal axis 12*a*, a width extending along a latitudinal axis 12*b*, and a front face 12*c*. Front face 12*c* has a length extending along longitudinal axis 12*a* and a width extending across latitudinal axis 12*b*. In this case, housing 11 can be of any dimensions but in this example is formed as a single gang electrical enclosure.

Body section 14 has a strap 16 coupled to it as well as terminals 18 for connecting to a power input line or a downstream load. Front cover 12 has a user accessible interface in the form of a duplex receptacle comprising a first set of apertures 17*a* representing a first receptacle unit, and a second set of apertures 17*b* representing a second receptacle unit, thereby forming an example of a duplex user accessible interface. In this case, each set of apertures is for receiving a plug. In addition, an optional indicator light 19 is coupled to front cover 12 wherein indicator light 19 is used to indicate the status of the device.

Coupled to front cover 12 is a cover or lens unit 20 which can be transparent or translucent and be used to allow light to pass therethrough. In this case, translucent shall be defined as any material including transparent material which allows light to pass therethrough.

Cover 20 extends in an elongated manner, in a manner parallel or substantially parallel to longitudinal axis 12*a* of housing 11, and substantially transverse to latitudinal axis 12*b* of housing 11. Cover 20 has a length extending along longitudinal axis 12*a* and a width extending along latitudinal axis 12*b*. In this case, translucent cover 20 extends along a length or longitudinal axis in a manner such that it extends a sufficient length to provide sufficient illumination to an area around device 10. While the length of the cover can be any acceptable length, depending on the desired amount of light presented, in one embodiment this translucent cover 20 extends at least ¼ or 25% of a length of front face 12*c*. Alternatively, if more light is desired, front cover 20 is adapted such that this translucent cover 20 can extends at least ⅓ of the length of front face 12*c*, while if desired, in another embodiment, this translucent cover 20 extends at least ½ or 50% of the length of the front face 12*c*.

One of the reasons for the size of the translucent cover 20 is that it can be used to cover both a light emitter such as a LED and an optional sensor underneath this cover.

Cover or lens 20 is formed in any suitable manner and with any suitable material such that it allows light to pass therethrough. For example, this cover is formed from transparent material or translucent material which can be made from any appropriate material such as plastic or glass.

For example, this cover 20 allows light to pass through cover 20 to provide a sufficient amount of light to guide a person in a dark environment to that device as well as illuminate the surrounding area. This feature can be useful because on a periodic basis, fault circuit interrupters such as GFCI's need to be tested and reset. If a person had to reset a GFCI, it might become difficult in a dark room without additional light. In addition, this cover allows a light to pass inside of this cover such that this light is read by an optical sensor as well. In that way, an optical sensor such as sensor 34 (See FIG. 2) disposed inside housing 11 could read the ambient light levels of the surrounding environment to determine whether to illuminate the light disposed inside of light cover 20.

Figure 2:
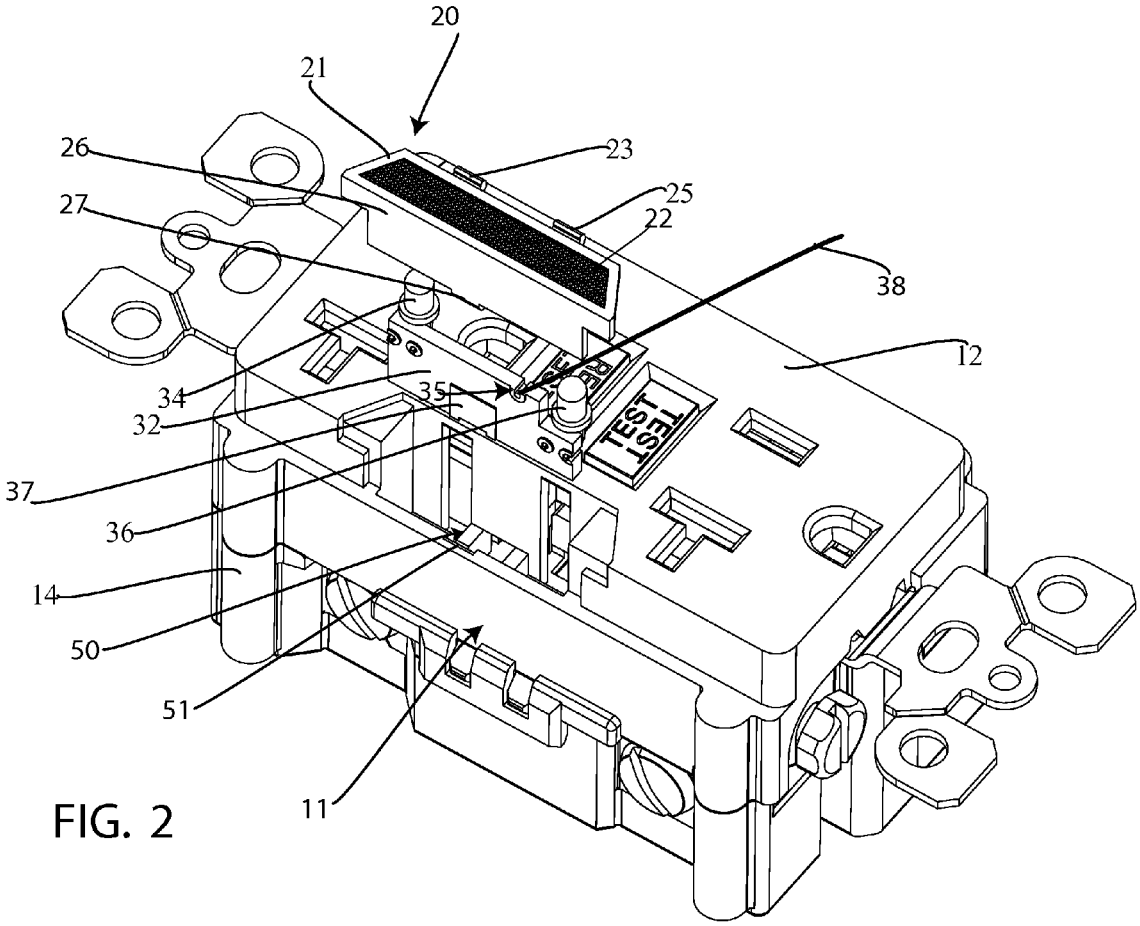
FIG. 2 is an exploded perspective view of the embodiment disclosed in FIG. 1.

FIG. 2 discloses a perspective view of one embodiment of the invention. In this view, there is cover 20 having a front planar surface 21 having a roughened or ribbed section 22 and tabs 23 and 25 which are used to connect cover 20 to housing 11 at a first end. Roughened section or ribbed section 22, in at least one embodiment is connected to an opposite inside surface of cover 20 as well and has different surfaces of different angles so that light that is passed through this section is emitted in many different directions creating a light emitting surface that is easily viewable from many different directions.

Cover 20 also has a side planar surface 26 which extends substantially perpendicular to planar face or surface 21. A clip or tab 27 is connected to this side planar face or surface 26 such that cover 20 can be first coupled to housing 11 via tabs 23 and 25 at the first end, and then secured at the second end via tab 27 which snaps into a notch 51 in housing 50.

Cover 20 can be of any particular shape. In this case, front planar surface 21 is trapezoidal in shape while side planar surface 26 is rectangular in shape. Cover 20 can be shaped trapezoidally to match its shape with housing 50. Housing 50 is shaped in this manner to accommodate face terminals 60 (See FIG. 5). Housing 50 is formed in cover 12 as a separate well for receiving and securing modular components.

Cover 20 is designed to cover second circuit board 32, which when this embodiment is in an assembled condition, is disposed below cover 20 and inside housing 50 and housing 11. Second circuit board 32 can include any necessary components and in this case, comprises a light sensor 34 coupled to, or in communication with a LED emitter 36. Second circuit board 32 is designed in a modular form such that it can be snapped into housing 50 and connected electrically to a power input inside housing 11. For example, circuit board 32 includes a connecting notch 35 which enables this board to be electrically connected to a face terminal 69 via an associated wire (See FIG. 5) and also includes a clip or contact 37 which can be secured onto an associated face terminal 61 (See FIG. 5). These connections between connecting notch 35 and clip 37 can be used to connect the circuit board 32 to terminals 61 and 69 to form a circuit loop.

Light sensor 34 is coupled to second circuit board 32 and can be used to detect either the presence or the absence of light. For example, with this embodiment, this GFCI light system can be used as a night light such that when sensor 34 detects the absence of a predetermined amount of light, it sends a signal to turn on light 36. Light can then radiate out from cover 20 from both top surface 21 and side surface 26 creating a wide reaching beam of light.

Figure 3:
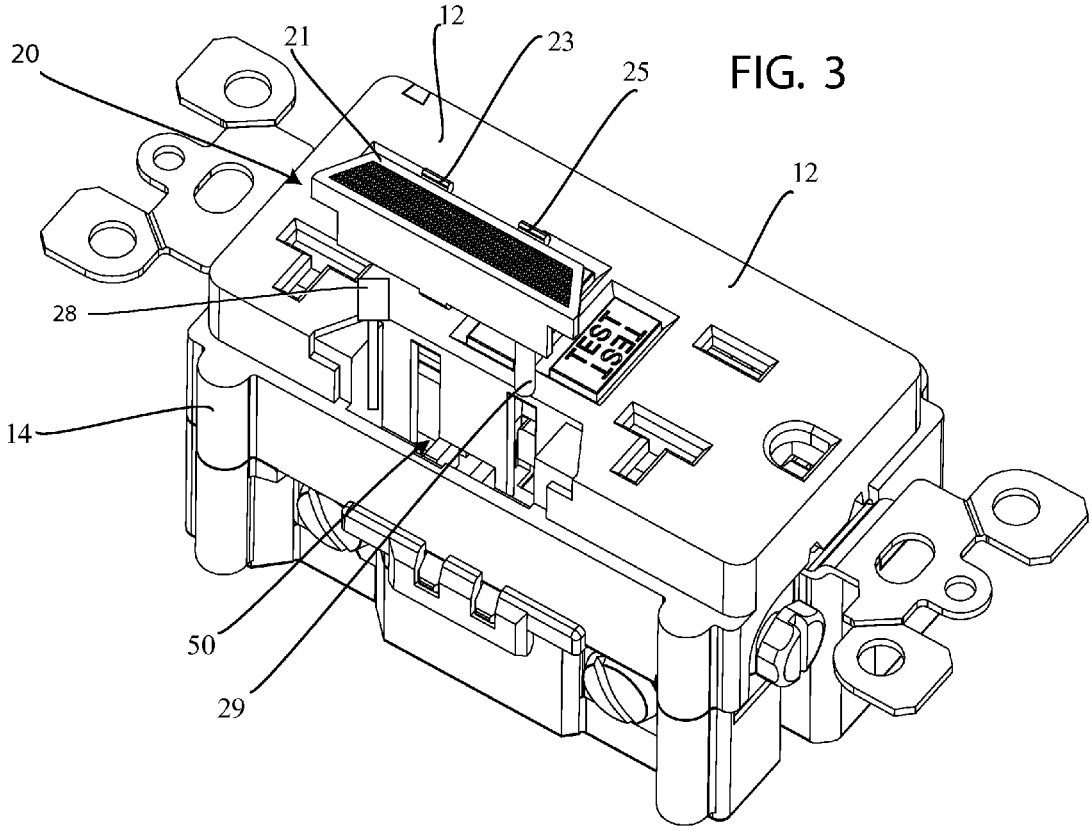
FIG. 3 is an exploded perspective view of another embodiment based upon the disclosure in FIG. 1.

FIG. 3 discloses a perspective view of another embodiment of the invention. In this view, there is shown translucent cover 20 having front planar surface 21 having tabs 23 and 25. Disposed inside of housing 50 is a sensor 28 and a light pipe 29. Light pipe 29 is coupled at one end to lens cover 20 and to a LED light emitter 164 (See FIG. 12) at an opposite end. Sensor 28 can connect electrically to circuit board 140 or an additional circuit board 160 (See FIG. 12) to form an electrical circuit having a switch.

Figure 12:
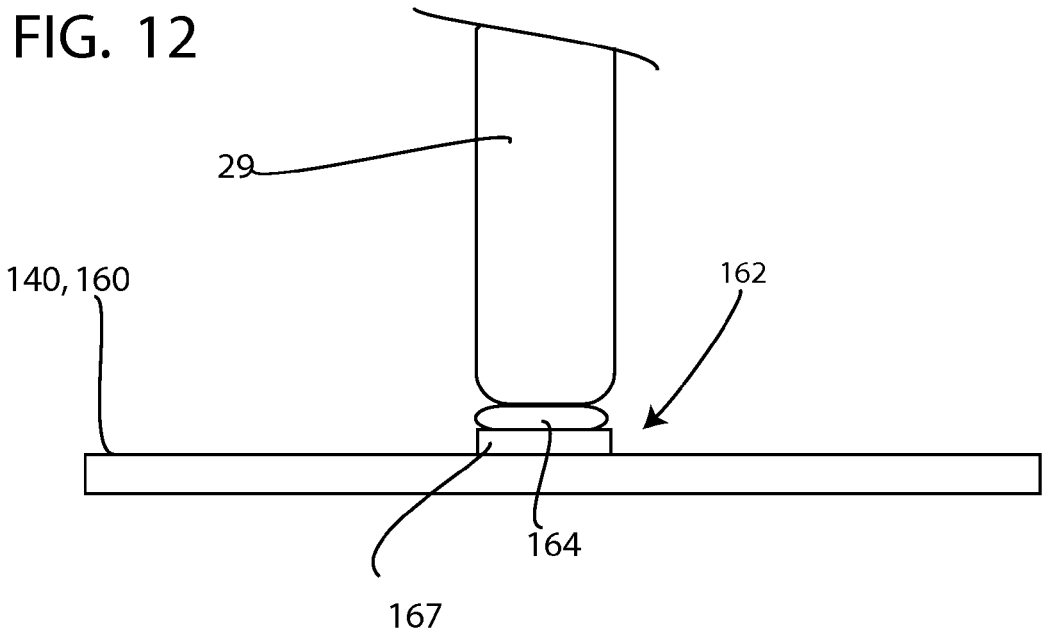
FIG. 12 is a side view showing a connection between a light pipe and a circuit board.

With this design, as shown in FIG. 12, light is emitted from an associated LED light and flows through light pipe 29 wherein this light is then refracted and reflected through translucent cover 20.

Figure 4:
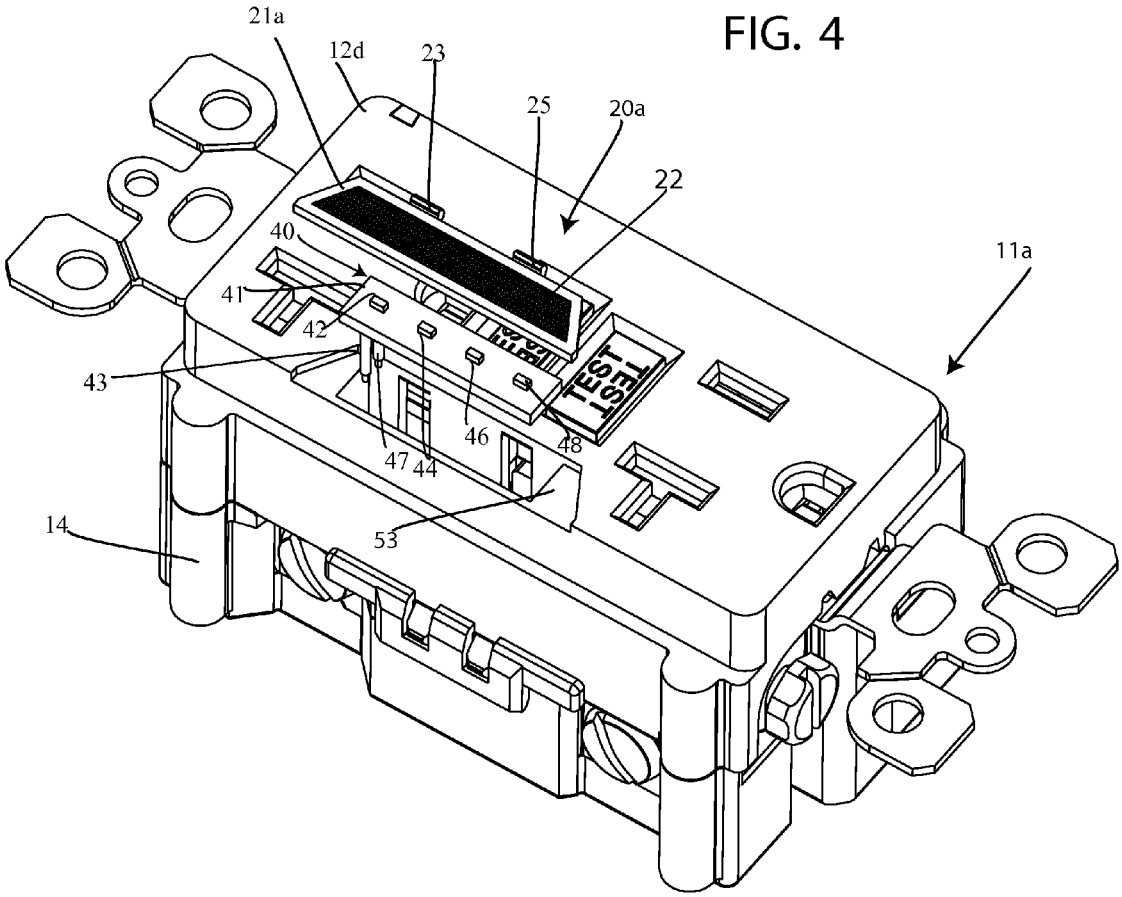
FIG. 4 is an exploded perspective view of another embodiment.

FIG. 4 discloses an exploded view of another embodiment of the device shown in FIG. 1. For example, device 10 includes a lens section or light cover 20*a* having a cover plate 21*a* forming a lens cover having tabs 23 and 25 and a ribbed or roughened section 22. Cover 20*a* does not include a side plate 26 as shown in FIG. 2. This cover plate 21*a* can be coupled to housing face plate 12*d* to cover an LED array 40 disposed below cover 20*a*. LED array 40 includes a circuit board 41 and a plurality of LED lights 42, 44, 46, and 48. Each light is coupled to circuit board 41 wherein this board is also coupled to a plurality of wires 43 and 47. Wires 43 and 47 extend down from circuit board 41 and are coupled to associated face terminal contacts 60 (See FIG. 5) or other power inputs on a circuit board or other contacts upstream from a GFCI switch.

Top cover 12*d* is formed so that it has a ledge 53 to allow circuit board 41 to rest on top. Circuit board 41 rests on top of ledge 53 disposed inside of housing 11*a* and above the GFCI circuit board disposed inside. In addition, in at least one embodiment, a sensor such as sensor 34 (See FIG. 5) is incorporated into or disposed on board 41 to selectively turn on or off these lights. Alternatively, circuit board 40 can reside inside of housing 50 with cover plate 21*a* resting on ledge 53.

Figure 5:
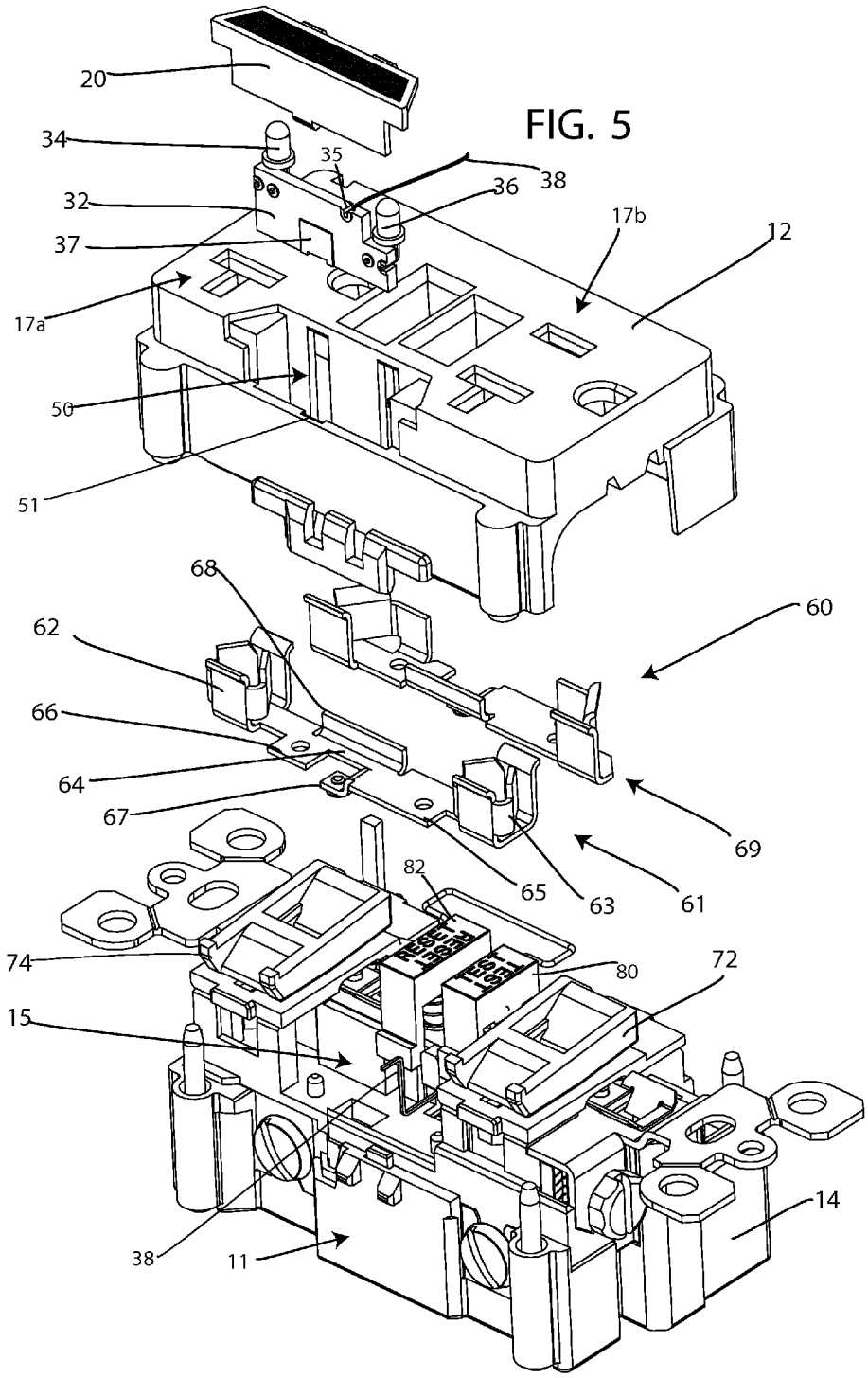
FIG. 5 is an exploded perspective view of the embodiment shown in FIG. 2.

FIG. 5 discloses an exploded perspective view of the embodiment shown in FIG. 2. For example, there is shown light cover 20 which is coupled to housing 12 over second circuit board 32. Second circuit board 32 has a light sensor 34 as well as light 36 as disclosed above. In addition, board 32 includes connecting element or notch 35 which allows this circuit board to be connected to wire line 38. Second circuit board 32 also includes a clip or contact 37, such that clip or contact 37 and wire or line 38 can be used for electrically connecting this board to a power input. As described above, board 32 fits inside housing 50 which is formed in front cover 12. Housing 50 is shaped such that it has a trapezoidal cross section, which forms in a center region, wherein openings for prongs on face terminals 60 extend up to openings in cover 12.

With this design, second circuit board 32 is coupled to a plurality of face terminals 60. Face terminals 60 are designed from a metallic material and are designed to provide power to the open receptacle regions in cover 12. These face terminals 60 along with apertures 17*a* and 17*b* (see FIG. 1) form a user accessible interface for plugs.

This plurality of face terminals can include face terminals 61 and 69 which are disposed on either side of this housing and are designed to accommodate at least one second circuit board such as circuit board 32 disposed inside of the housing.

First terminal 61 is substantially identical to second terminal 69 and essentially includes the same components. For example, first terminal 61 includes contact ends 62 and 63 disposed at each end. In addition, there is a main body or busbar section 64 which has extended sections 65 and 66 disposed on either side, wherein these extended sections are designed to have a sufficient surface area to handle the normally applied power flowing through these terminals. Coupled to main body section 64 is a contact 67 which is designed to contact with switches associated with the GFCI. This design also includes a bent or raised contact section 68 which extends up substantially perpendicular from main body section 64. Raised contact section 68 forms a bent or raised contact for contacting with circuit board 32, and also provides additional surface area for power to flow across these terminals 61, and 69.

This disclosure also shows tamper resistant interfaces 72 and 74 which are substantially disposed inside the housing. In addition, a test switch 80 and a reset switch 82 are also disposed at least partially inside of this housing.

When the device is assembled, terminals 61 and 69 fit in on each side of this housing. For example, terminal 61 can fit into a main gap region 15 in housing 11. Thus, bent or raised contact 68 extends up in gap region 15. When cover 12 is placed over these contacts or terminals 61 and 69, raised contact 68 extends inside of housing 50. Next, when circuit board 32 is inserted inside of housing 50, it can be adjusted such that wire 38 inserts into connection element or notch 35 electrically connecting one end of circuit board 32 to a face terminal such as face terminal 69. In addition, clip 37 inserts onto raised contact 68 to form an electrical connection. Next, cover 20 can be snapped on to cover 12 to cover this opening in cover 12.

Figure 6:
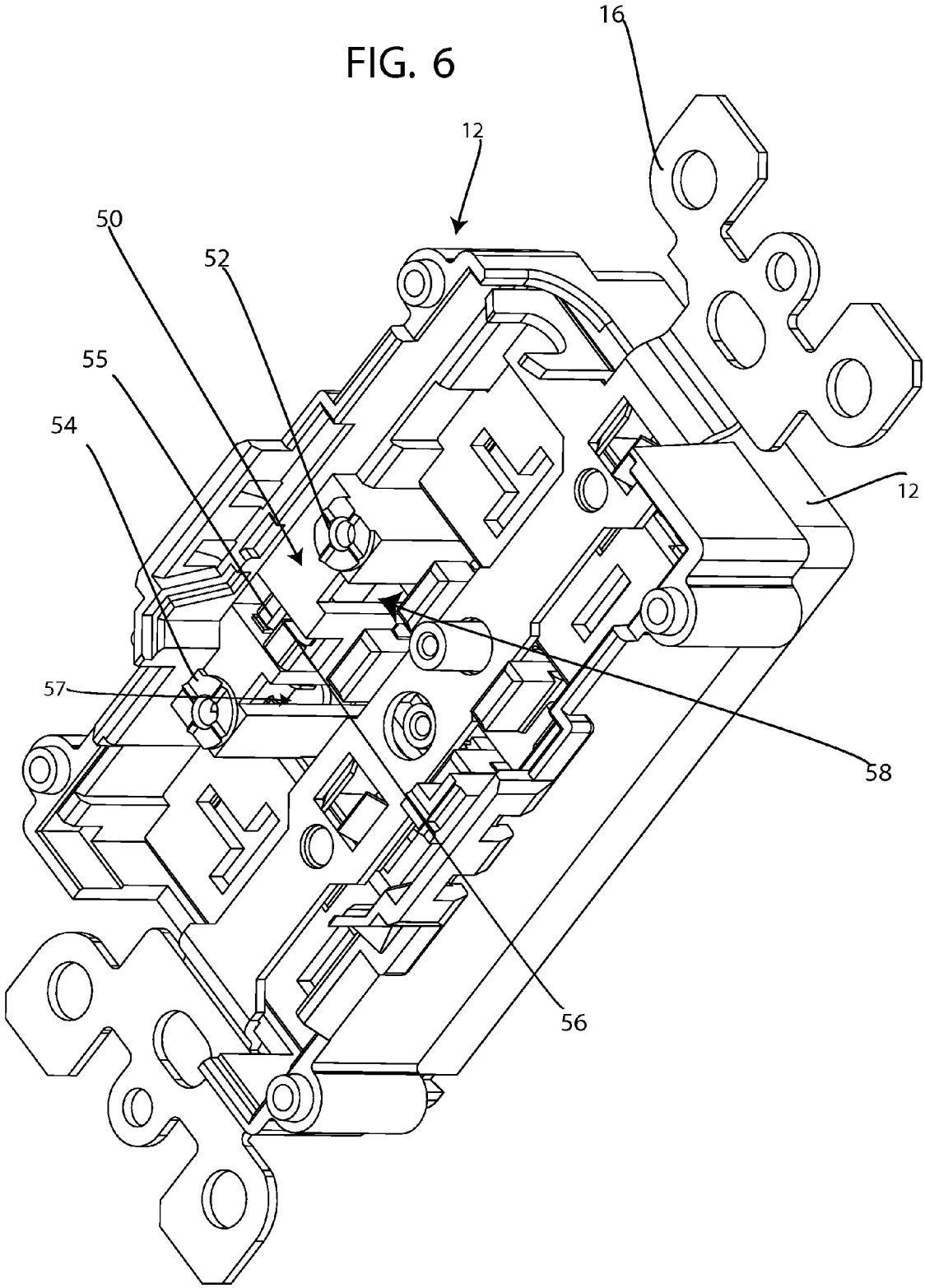
FIG. 6 is a back side view of the cover shown in FIG. 1 having a housing.

FIG. 6 discloses a perspective back view of front cover 12 connected to strap 16. In this view, housing 50 is formed in cover 12 and includes light pipe access holes or sections 52 and 54. There are also two opposing clips 55 and 56 disposed in housing 50. Clips 55 and 56 snap together to allow a circuit board, such as circuit board 32, (See FIG. 5) to fit securely therein. In addition, this housing has openings or gaps 57 and 58 which are designed to allow wires or other items to feed there-through. In this case, wires can feed through to connect circuit board 32 to face terminals 60.

Figure 7A:
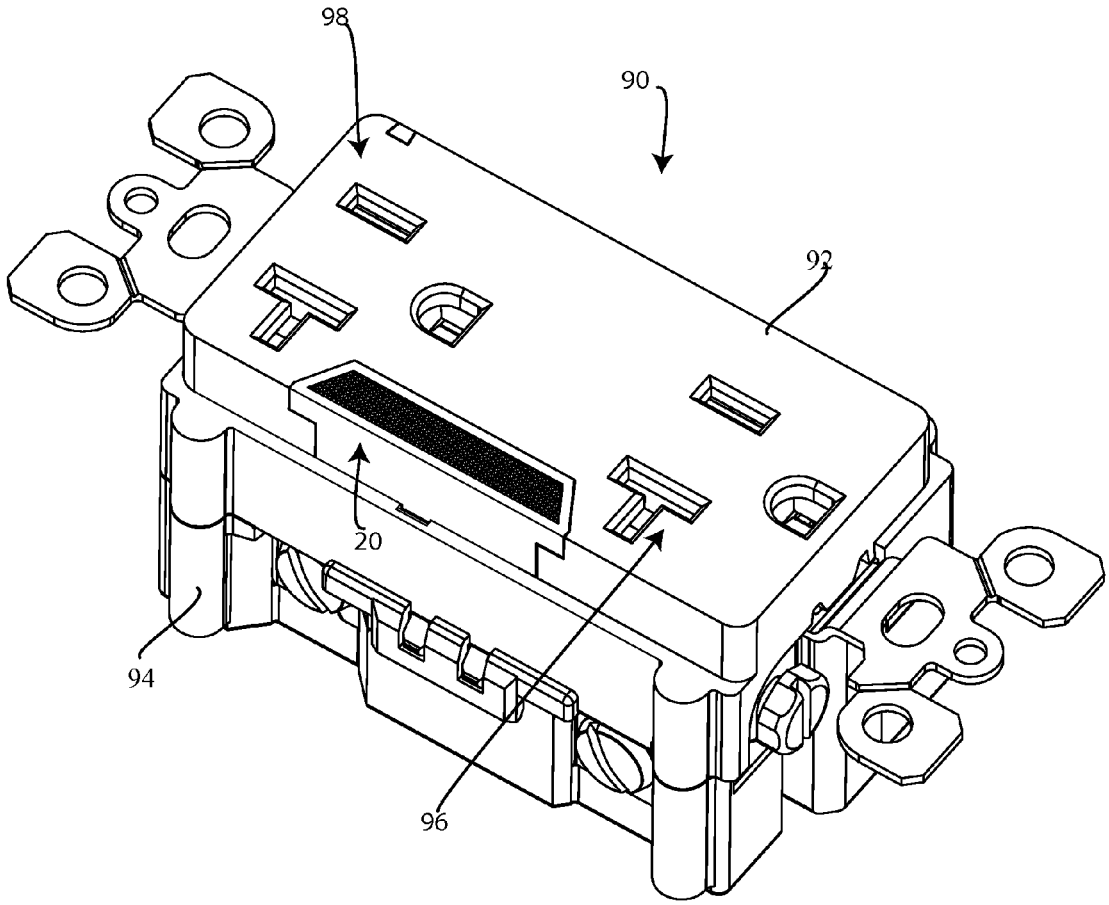
FIG. 7A is a perspective view of another embodiment in a non-GFCI device.

FIG. 7A discloses a perspective view of another embodiment of the invention. For example, in this view, this embodiment 90 relates to a receptacle device that is not a fault circuit type device. This embodiment includes cover 92 coupled to base 94 forming a housing. In this view, lens or cover element 20 is coupled to cover 92 in a manner similar to that shown in FIGS. 1 and 2. Cover 92 is similar to cover 12 and can include an additional housing for housing a circuit board such as circuit board 32 having sensor 34 and light 36 coupled to it. Alternatively, other designs disclosed herein such as shown in FIGS. 3 and 4 can also be used as well.

Figure 7B:
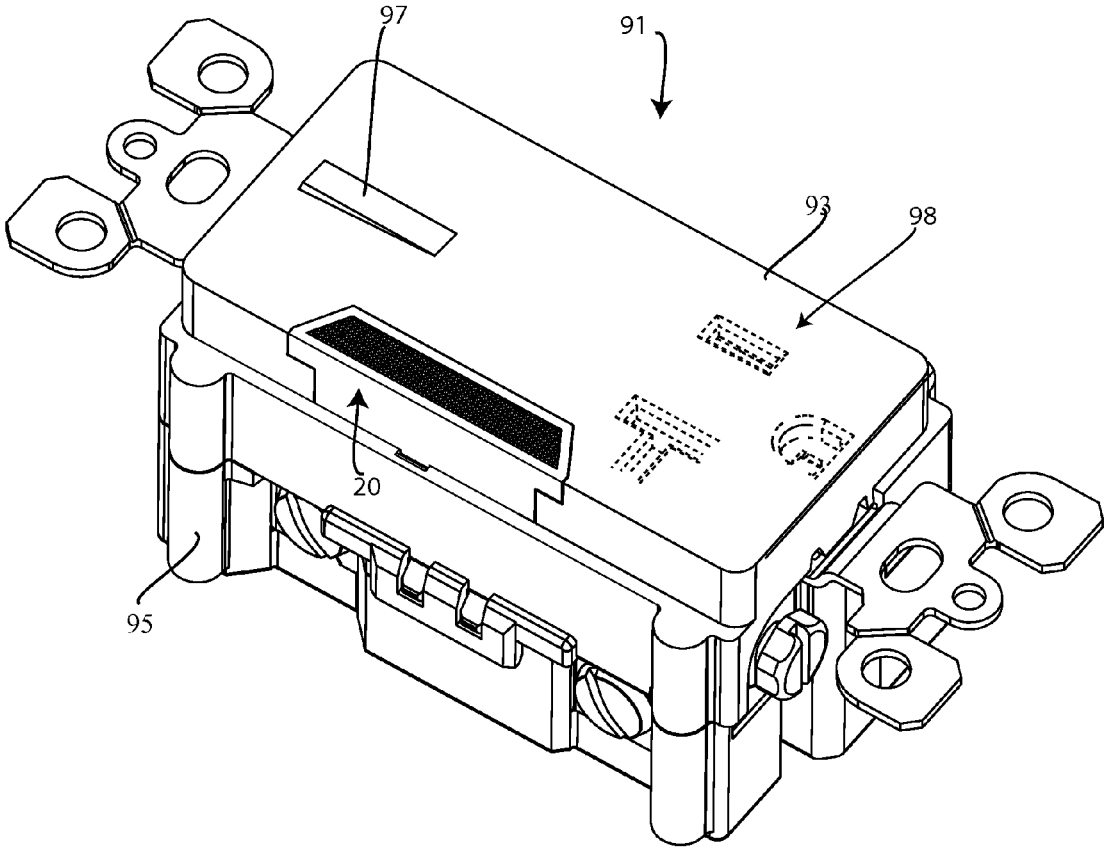
FIG. 7B is a perspective view of another embodiment with a switch as an electrical component.

FIG. 7B discloses a perspective view of another embodiment which includes a combination switch and light device 91. This device includes a front cover 93 and a back cover 95. Light cover 20 is coupled to front cover 93. In addition, there is a switch 97 coupled to front cover 93 as well. Switch 97 is disposed adjacent to an optional receptacle unit 98 which is shown by dashed lines. As with the embodiment disclosed in FIGS. 1-6, this device can include the components disposed below cover 20 including a second circuit board, at least one light, a sensor, and an additional housing.

Figure 8:
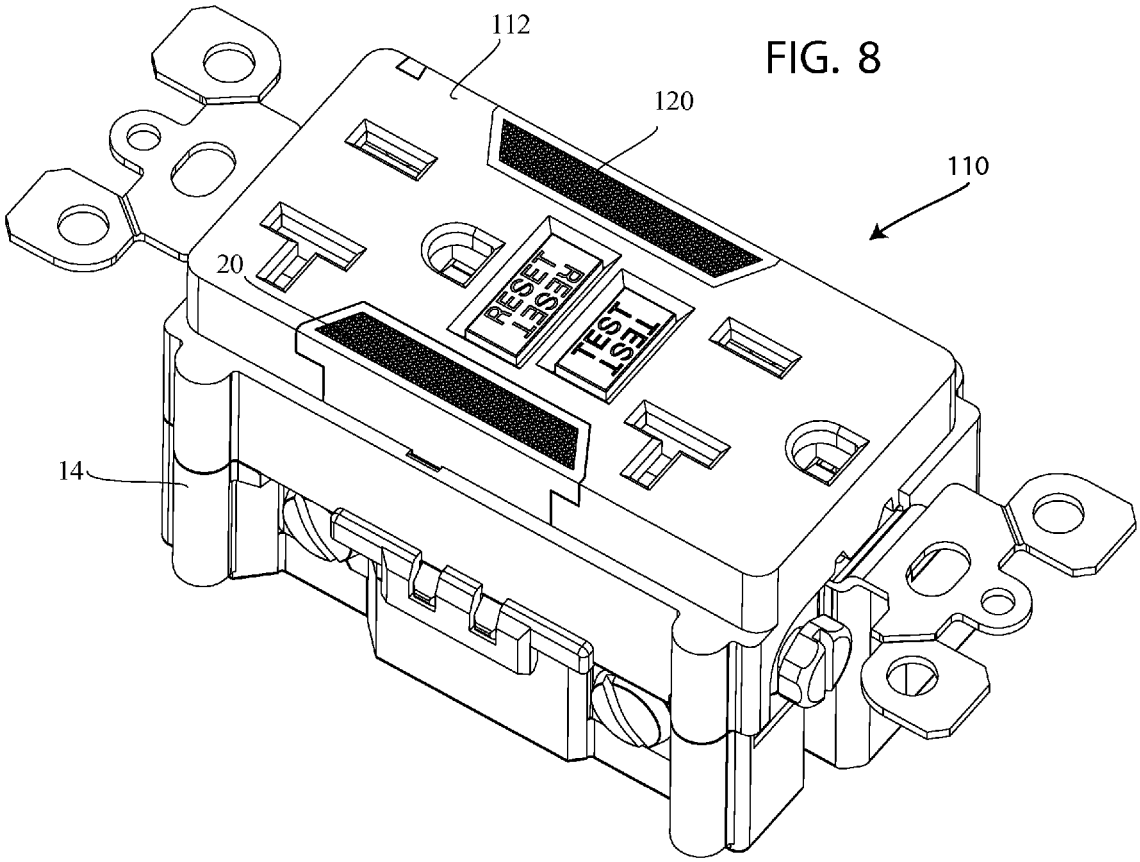
FIG. 8 is a perspective view of another embodiment of the invention.

FIG. 8 discloses a perspective view of another embodiment of the invention 110. In this embodiment, there is shown a cover 112 which is adapted to allow two light covers 20, and 120 to be disposed in a single housing. For example, there is a first light cover 20 coupled to cover 112 and a second light cover 120 coupled to cover 112. Cover 112 is coupled to body section 14 as well. As with the embodiments disclosed in FIGS. 1-6, this device includes the components disposed below cover 20 shown in those embodiments wherein those components are disposed under each of covers 20 and 120. In this way, two different lights or two different sets of lights can be activated on both sides of cover 112 to provide a guidance or night light to individuals.

Figure 9:
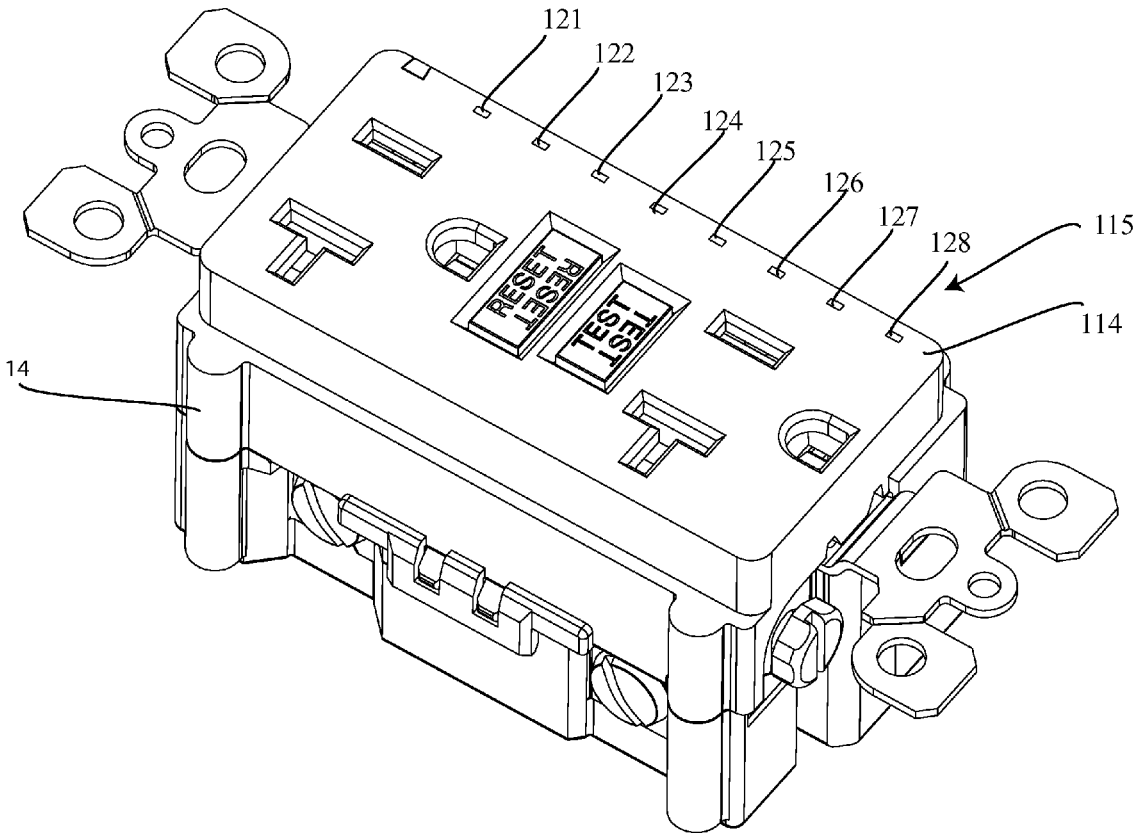
FIG. 9 is a perspective view of another embodiment of the invention.

FIG. 9 discloses a perspective view of another embodiment of a combination GFCI and lighting apparatus 115. With this design, there is a unique cover 114 coupled to base 14, which has a series of sections 121, 122, 123, 124, 125, 126, 127, and 128, that can be either translucent or transparent. In one embodiment, each section represents an individual light (See FIG. 11D). In another embodiment, all of the sections cover one elongated light bar disposed below these sections (See for example FIG. 11C).

Figure 10:
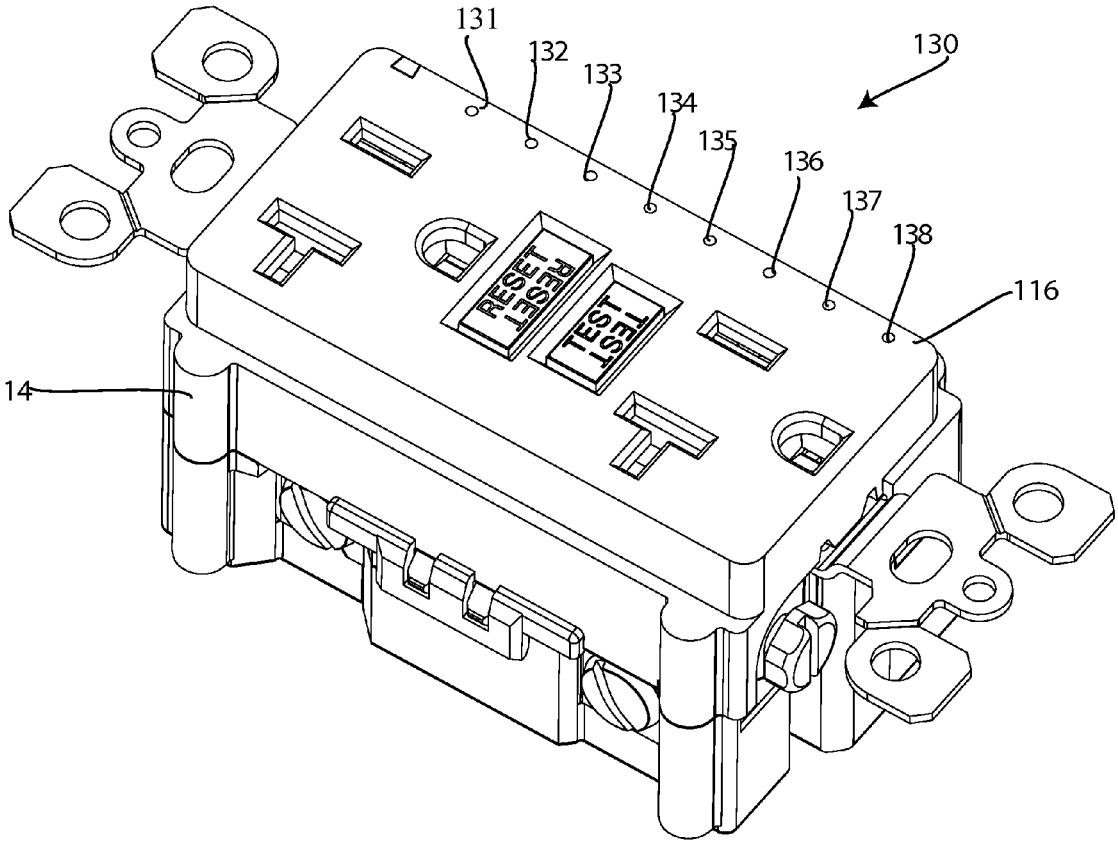
FIG. 10 is a perspective view of another embodiment of the invention.

FIG. 10 discloses a perspective view of another embodiment of the invention 130. In this embodiment, there is a cover 116 which has a plurality of sections 131, 132, 133, 134, 135, 136, 137, and 138 that can be formed from either translucent or transparent material or any other material that allows light to pass there-through. These sections are circular in shape, wherein each light section can represent an individual light (See FIG. 11D) or, all of the light sections 131 to 138 are illuminated by a single light disposed below cover 116 (See FIG. 11C).

FIGS. 11A-11D disclose the different schematic block diagrams of different circuit boards that can be used with the different embodiments. For example FIG. 11A discloses a circuit board 140 which can be known as a first circuit board, having GFCI circuitry 142, and LED components 162 (See also FIG. 12). This board 140 is disposed inside of housing 11 in a manner known in the art. LED components 162 are for providing light through a light pipe such as light pipe 29 (FIG. 3). For example, with this embodiment, power can flow from circuit board 140 into LED components 162 illuminating a LED light emitter. An associated sensor such as sensor 28 as shown in FIG. 3 is wired to board 140 to receive power from board 140 and also be wired to, or in communication with LED components 162 to selectively turn these components 162 on or off depending on whether there is the presence or absence of light.

Figure 11A:
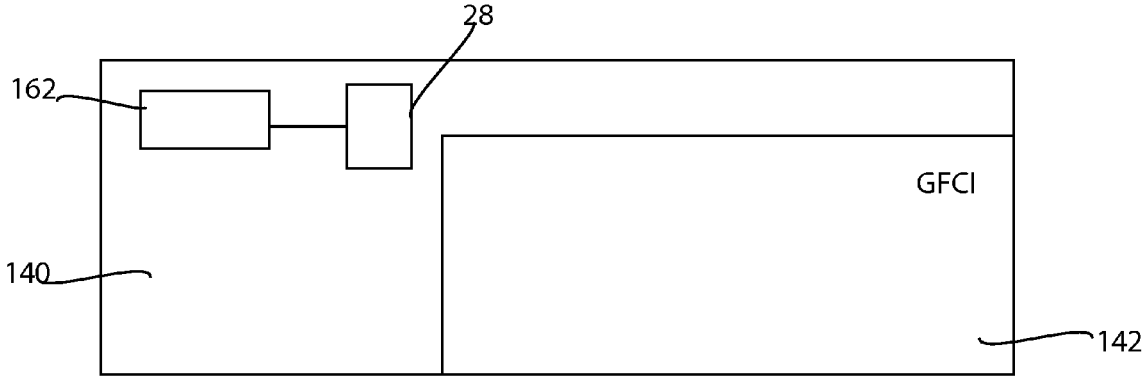
FIG. 11A is a simplified block diagram of a first circuit board having a microprocessor and a light.
Figure 11B:
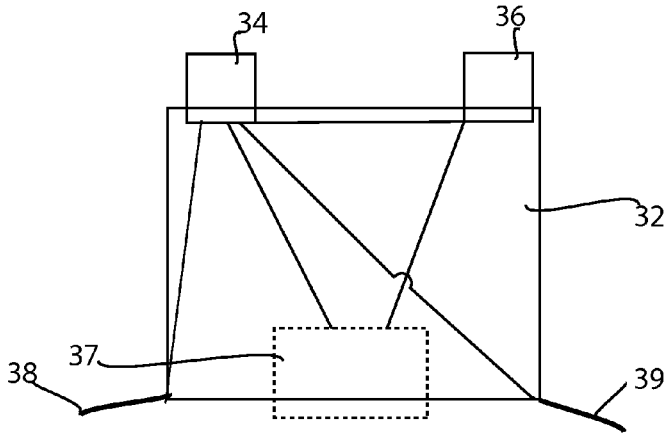
FIG. 11B is a simplified block diagram of a first embodiment of a second circuit board.

FIG. 11B discloses a schematic block diagram of second circuit board 32 which is also shown by way of example in FIG. 2. In this case, second circuit board 32 includes a sensor 34 and a light which is in the form of a LED light 36. This design can includes a first wire 38 which as disclosed above, can be coupled to one of the face terminals 60 (FIG. 5), while clip 37 can be used to couple to an opposite face terminal. Alternatively, there can be an additional wire 39 which can is designed to couple to another face terminal instead of clip 37. In at least one embodiment, wire 39 is electrically coupled to sensor 34 and light 36 instead of clip 37. In at least one embodiment, the wires 38 and 39 are coupled to the face terminals 60 or to circuit board 140 downstream of the GFCI components such that when the GFCI components are tripped, the light is disabled. In another design, these wires or contacts 38 and 39 are coupled to any power input positioned upstream from the GFCI components 142 so that the LED light and sensor can remain lighted regardless of whether the GFCI is tripped.

Figure 11C:
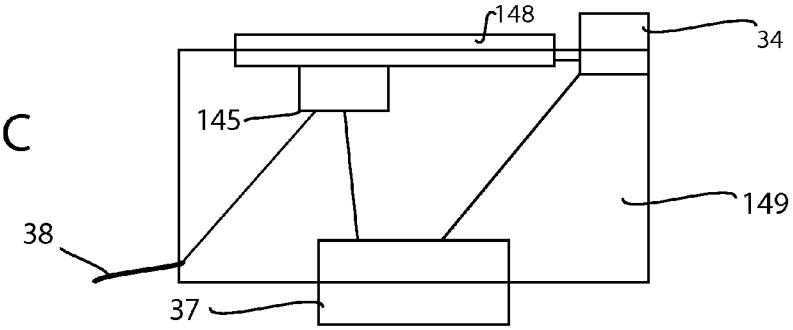
FIG. 11C is a simplified block diagram of a second embodiment of a second circuit board.

FIG. 11C discloses another embodiment of a second circuit board 149 which is similar to circuit board 32 however, this circuit board has an elongated light 148 in the form of a light bar 148 coupled to it. In this case, there is a LED emitter 145 which is coupled to light bar 148 to provide an elongated beam of light. This light bar 148 extends along light cover plate 20 and can also be used to provide light to a plurality of light cover plates such as those light cover plates shown in FIGS. 9 and 10. This device electrically connects to the remaining components in any suitable manner such as through clip 37 or wires 38 or 39 described above.

Figure 11D:
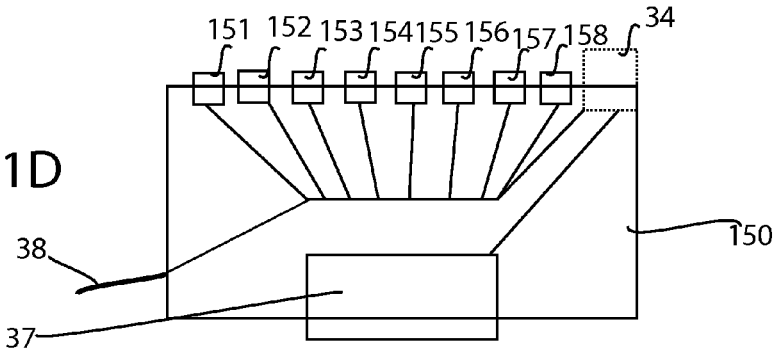
FIG. 11D is a simplified block diagram of a third embodiment of a second circuit board.

FIG. 11D discloses another embodiment of another circuit board 150. This circuit board 150 is similar to that of circuit board 32 however, this circuit board includes a plurality of separate LED lights or LED emitters. These lights 151, 152, 153, 154, 155, 156, 157 and 158 are all in communication with sensor 34. As disclosed above, when sensor 34 determines either the presence or absence of light, then this sensor 34 will allow power to flow to these lights to illuminate the associated lights or LED emitters or turn them off. In at least one embodiment, additional connection wires 38 and 39 are connected to this board in a manner disclosed above in FIG. 11B to form a connectable circuit on this board.

FIG. 12 discloses a side view of a connection between light pipe 29 and an associated motherboard which can be either motherboard 140 or motherboard 160. As discussed above, motherboard 140 is a motherboard associated with GFCI circuitry. In this case, a set of LED components 162 including a LED emission lens 164 and LED circuitry 167 are disposed on this motherboard.

Alternatively, these LED components 162 can be housed on a motherboard 160 which can be formed separate from GFCI motherboard 140. Motherboard 160 is disposed in a base region of housing 50 and is electrically connected to face terminals 60 (FIG. 5) or to other contacts upstream of the GFCI components.

Light pipe 29 connects to lens element 164 such that light is sent up light pipe 29 until it reaches lens or cover 20 (See FIG. 3) providing an emission of light from cover 20 which originates from emission lens 164.

Figure 13:
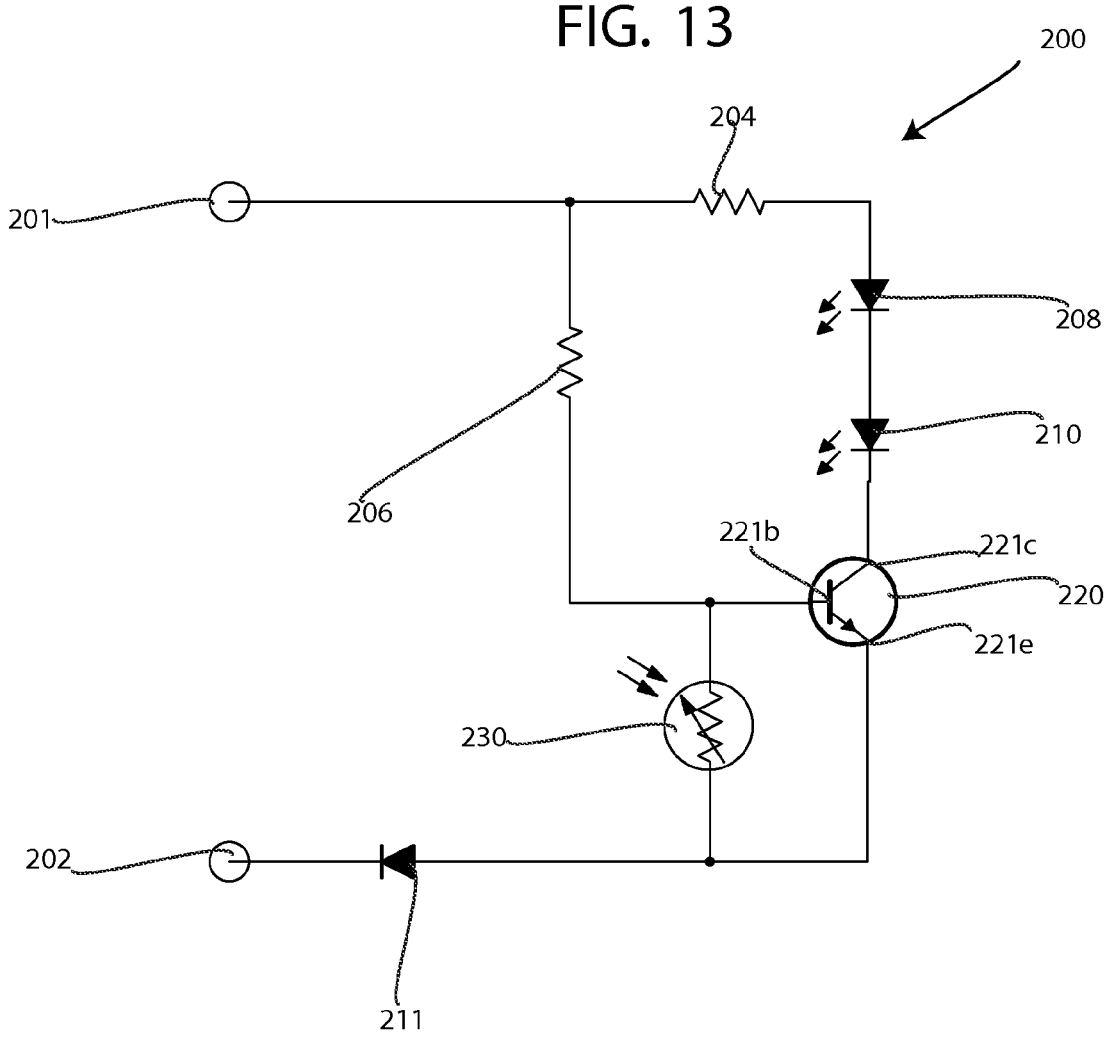
FIG. 13 is a circuit diagram showing a first embodiment for a circuit including a sensor and a light.

FIG. 13 is a schematic circuit diagram 200 of a sensor 28 or 34 and any associated lights such as LED 36, LED 145, LEDs 151-158, or LED components 162. This circuit diagram is representative of components that in at least one embodiment, are disposed or coupled to in circuit board 32, or circuit boards 41, 140, 149, 150 or 160. In this case, this design includes contacts 201 and 202 formed by any one of contact 37 or wires 38, 39, 43 or 47 (See FIGS. 2, 3, 4, and 11B). For example, contact 201 is electrically coupled to the phase line, while contact 202 is coupled to the neutral line. There are also a plurality of resistors 204 and 206 which can are used to control the current passed through associated electrical components such as LEDs 208 and 210, and a diode 211 which allows current to flow through these wires on every positive half cycle.

While two LEDs 208 and 210 are shown in this diagram, a single LED such as light 36 can be positioned in this location or multiple LEDs such as four LEDs shown in FIG. 4, or eight LEDs 151-158 (See FIG. 11D) can also be placed along this line. A transistor 220 which is formed as an N-P-N transistor having a collector end 221*c*, a base end 221*b*, and an emitter end 221*e*, is positioned adjacent to these LEDs 208 and 210. A photoresistor 230 is connected between the base 221*b* and emitter 221*e* of the transistor 220. Photoresistor 230 acts as a sensor, such as sensor 34, and operates such that it has a varying resistance based upon the amount of light received. For example, when the amount of light received on the photoresistor 230 is high, the resulting resistance is low. When there is the absence of light or a low light situation, then the resulting resistance is high. In this case, when the resistance is low in photoresistor 230, current flows through this photo resistor 230 and out through contact 202. In this case, a relatively low level of voltage would be generated between base 221*b*, and emitter 221*e* which would be below the threshold voltage necessary to turn transistor 220 on.

Alternatively, if the resistance in photoresistor 230 is high during a low light period, then the resulting voltage generated between base 221*b* and emitter 221*e* would be sufficient to activate transistor 220 to turn this transistor on, to allow power to flow through LEDs 208 and 210 and to turn LEDs 208 and 210 on.

Figure 14:
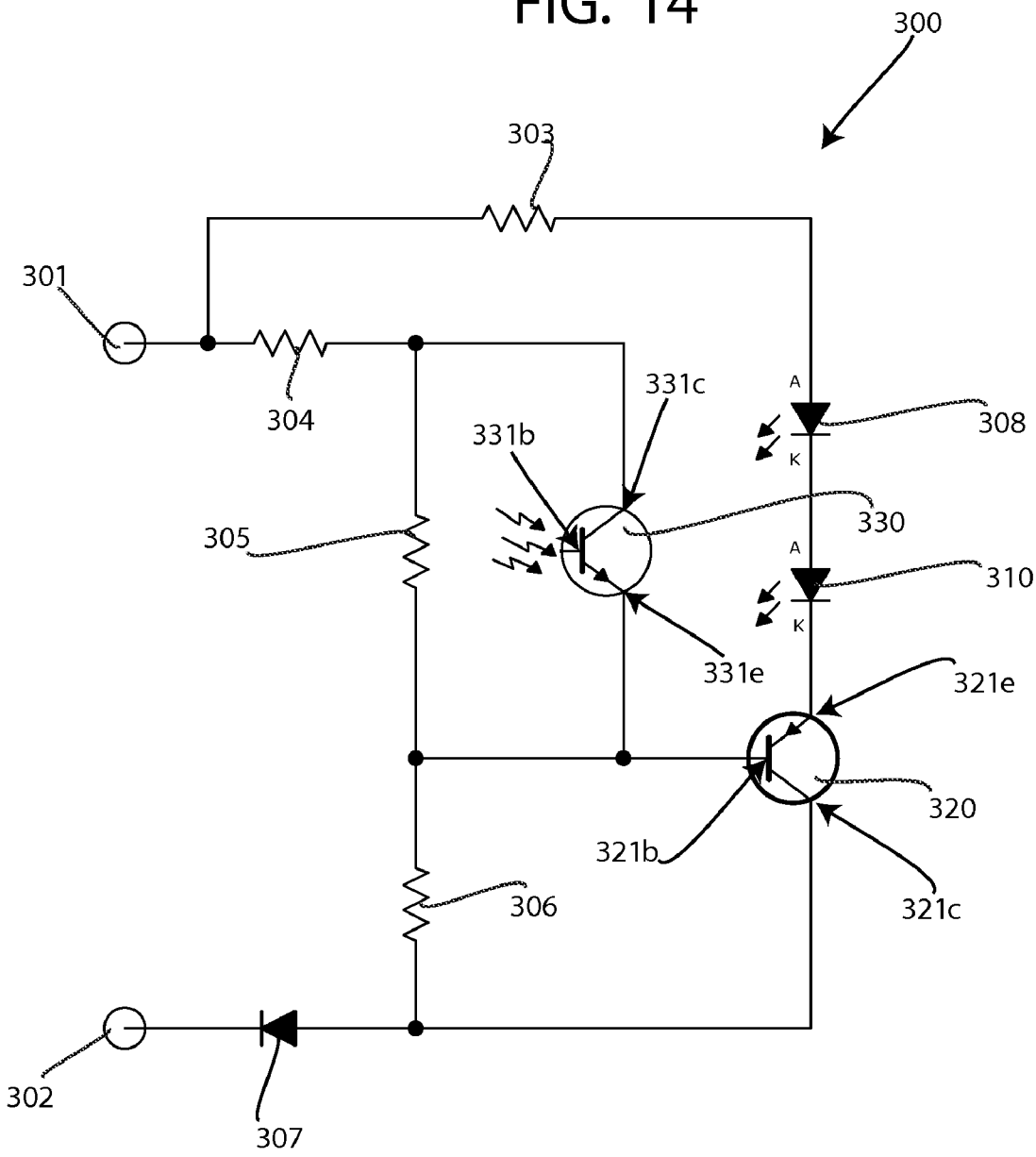
FIG. 14 is a circuit diagram showing a second embodiment for a circuit including a sensor and a light.

FIG. 14 shows a schematic block diagram of an alternative embodiment showing a circuit layout 300 of components which are housed on an associated circuit board such as circuit board 32 or circuit boards 41, 140, 149, 150 or 160 (See FIGS. 2, 11A, 11C, 11D, and 12). In this case, there is a dual transistor layout, wherein at least one transistor is designed to take the place of the photoresistor of FIG. 13. With this design, there is a line input 301, which is associated with contact 37 or wires 38, 39, 43, or 47 which is connected to the phase input line. Another line 302 is associated with a contact or one of the wires as well and is coupled to a neutral line. A plurality of resistors, 303, 304, 305, and 306 are positioned around this circuit to control the current flowing through this circuit. There is also a diode 307 which acts to allow power to flow through these wires on every positive half cycle.

This design also shows two LEDs 308 and 310, however just as with the other embodiment, while only two LEDs are shown, an embodiment having a single LED can be made from this design (See FIG. 2) or an embodiment with multiple LEDs can also be made (See FIG. 11D). These LEDs are coupled in series with each other along a line that is coupled to the emitter of transistor 320. Transistor 320 has a base end 321*b*, a collector end 321*c* and an emitter end 321*e* and is formed as a P-N-P transistor.

In addition, there is a photo transistor 330 which acts such that when there is a significant amount of light, this energy is translated into electrons being injected in sufficient number into base 331*b* resulting in a relatively low resistance from collector 331*c* to emitter end 331*e*. This result causes a low level of voltage drop from emitter 321*e* to base 321*b* which keeps power from flowing through LEDs 308 and 310. Alternatively, when there is a low light condition or a relatively low light condition then there is relatively high resistance from collector 331*c* to emitter 331*e* in photo transistor 330. Accordingly, there is a resulting relatively high voltage drop across the emitter 321*e* to the base 321*b* causing power to flow through LEDs 308 and 310 thereby lighting LEDs 308 and 310.

Thus, with any one of the above embodiments, it is possible to place at least one LED emitter, and an additional light sensor inside of the housing in a space saving manner to determine the presence or absence of a particular amount of light and then selectively illuminating an area surrounding this housing.

In at least one of the above embodiments, the LED lights are arranged in a manner such that the device provides an illuminance of at least one foot candle.

Accordingly, while a few embodiments of the present invention have been shown and described, it is to be understood that many changes and modifications may be made thereunto without departing from the spirit and scope of the invention as defined in the appended claims.

What is claimed is:

1. A combination electrical device comprising:

a) a housing in the form of a single gang electrical enclosure, said housing have a body section and a front face;

b) a duplex user accessible interface formed on said front face and comprising at least two electrical components in a duplex form disposed in said housing;

c) at least one first light disposed in said housing;

d) at least one first translucent cover disposed on and coupled to said front face of said housing adjacent to said duplex user accessible interface said at least one translucent cover configured to extend along at least ¼ of a length of said front face;

e) at least one second light disposed in said housing;

f) at least one second translucent cover, covering said at least one second light, said at least one second translucent cover disposed on and coupled to said front face of said housing adjacent to said duplex user accessible interface; said at least one second translucent cover configured to extend along at least ¼ of a length of said front face;

g) at least one sensor in communication with said light, and disposed in said housing, wherein said sensor determines an ambient amount of light disposed outside of said housing, and which selectively turns on or off said at least one light based upon a predetermined amount of detected light and wherein said body section of said housing is configured to be installed into a wall mounted electrical enclosure; and h) at least one connection element coupled to said housing and configured to connect to building wiring.

2. The device as in claim 1, wherein said duplex user accessible interface is in the form of a duplex receptacle comprising at least two receptacle units disposed in said housing and wherein said receptacle units comprise a first set of apertures in said front face representing a first receptacle unit and a second set of apertures in said front face representing a second receptacle unit.

3. The device as in claim 2, further comprising a fault circuit interrupter, wherein said fault circuit interrupter comprises at least one circuit board, and wherein the device further comprises at least one additional circuit board.

4. The device as in claim 3, further comprising at least one additional housing disposed in said housing, and at least one additional circuit board disposed in said at least one additional housing, wherein said at least one light and said at least one sensor are coupled to said at least one additional circuit board.

5. The device as in claim 4, further comprising at least one busbar, wherein said at least one additional circuit board further comprises at least one clip, and wherein said at least one additional circuit board is electrically coupled to said at least one busbar via said at least one clip.

6. The device as in claim 5, wherein said at least one translucent cover is coupled to said housing, and covering said at least one additional housing wherein said at least one light and, at least one sensor are coupled to said at least one additional circuit board, and said at least one translucent cover is for covering over said at least one light and said at least one sensor.

7. The device as in claim 6, wherein said at least one translucent cover is disposed adjacent to said receptacle units in said housing.

8. The device as in claim 6, wherein said housing has a front face having a length and wherein said at least one translucent cover is in the form of an elongated cover extending along at least one-third of said length of said front face.

9. The device as in claim 6, wherein said housing has a front face having a length and wherein said at least one translucent cover is in the form of an elongated cover extending along at least one-half of said length of said front face.

10. The device as in claim 6, wherein said at least one translucent cover has a first face and a second face with said first face disposed along a front face on said housing.

11. The device as in claim 10, wherein said second face on said at least one translucent cover extends substantially perpendicular to said first face.

12. The device as in claim 2, wherein said at least one light is coupled to said at least one additional circuit board in said housing, wherein the device further comprises at least one light pipe, and at least one translucent cover, wherein said at least one translucent cover is coupled to said housing, and wherein a first end of said light pipe is coupled to said translucent cover and a second end of said light pipe is coupled to said at least one light on said at least one additional circuit board.

13. The device as in claim 2, wherein the device further comprises a reset button and a test button, and wherein said light is disposed adjacent to said reset button and said test button.

14. The device as in claim 1, wherein said at least one light comprises at least one LED light.

15. The device as in claim 14, wherein said at least one light comprises a plurality of LED lights, and wherein said housing comprises a front cover and a back cover wherein said front cover includes a plurality of translucent sections with at least one translucent section positioned adjacent to at least one of said plurality of LED lights for allowing light to flow outside of said housing.

16. The device as in claim 1, wherein said connection element comprises a screw terminal which is configured to couple to building wiring.

17. The device as in claim 1, further comprising at least one of a test button and a reset button, coupled to said front face of said housing.

18. A combination electrical device comprising:

a) a housing in the form of a single gang electrical enclosure having a front face having a length;

b) at least one light disposed in said housing;

c) at least one sensor disposed in said housing, said at least one sensor determining an amount of ambient light outside of said housing and selectively turning on or off said at least one light based upon a predetermined amount of detected light;

d) a user accessible interface disposed in said housing comprising a duplex receptacle comprising a first plug interface and a second plug interface;

e) a ground fault circuit interrupter unit disposed in said housing and comprising at least one test button and at least one reset button coupled to said housing; and f) at least two translucent covers spaced apart from each other and coupled to said housing and extending lengthwise adjacent to said test button and said reset button, said translucent covers each having a first surface extending substantially flush with said front face of said housing and a second surface extending substantially perpendicular to said first surface, said at least two translucent covers comprising a first translucent cover for covering over said at least one light and said at least one sensor.

19. A combination electrical device for installation into a wall mounted electrical enclosure, the device comprising:

a) a housing having a front face having a length and a body section for installation into the wall mounted electrical enclosure;

b) at least one additional housing formed in said housing;

c) a circuit board disposed in said at least one additional housing;

d) a light coupled to said circuit board;

e) a sensor coupled to said circuit board wherein said sensor comprises: a phototransistor; and a transistor coupled to said circuit board, said phototransistor communicating with said transistor to form a selective switch for selectively turning on or off said light;

f) at least one electrical component having at least one user accessible interface coupled to said front face of said housing, in the form of a duplex electrical component wherein said user accessible interface comprises a set of apertures formed on said front face for receiving prongs of a plug; and g) at least one translucent cover coupled to said housing, said at least one translucent cover disposed on and extending along at least one fourth of said length of said front face on said housing wherein when the device is installed, at least a portion of the body section is disposed in the wall mounted electrical enclosure; and h) at least one fault circuit interrupter disposed in said housing, wherein said fault circuit interrupter has at least one test button, and at least one reset button disposed on said front face of said housing.

20. The combination device as in claim 19 wherein said at least one electrical component comprises a duplex receptacle unit for receiving at least two plugs.

21. The combination device as in claim 20, further comprising at least one face terminal wherein said at least one face terminal includes a main body section, extended sections, disposed on each side of said main body section, a contact, and at least one raised contact section extending substantially perpendicular to said main body section, said raised contact section for contacting with said circuit board.

22. The combination device as in claim 19, wherein said at least one electrical component comprises a switch.

23. A combination electrical device comprising:

a) a housing in the form of a single gang electrical enclosure having a body section and a front face section;

b) at least one contact comprising a terminal which is connectable to a power input line and which is coupled to said body section;

c) at least two electrical components arranged in said housing in a duplex manner and having a user accessible interface disposed on said front face and electrically coupled to said at least one contact;

d) at least one additional housing disposed in said housing; and e) at least one additional electrical component disposed in said at least one additional housing, said at least one additional electrical component having at least one circuit board wherein said body section is configured to be installed into a wall mounted electrical enclosure such as a wall box wherein said circuit board comprises at least one clip for electrically coupling to at least one of said at least two electrical components; and f) at least one translucent cover coupled to said housing, said at least one translucent cover disposed on and extending along said front face on said housing wherein when the device is installed, at least a portion of the body section is disposed in the wall mounted electrical enclosure.

24. The combination electrical device as in claim 23, wherein said at least one additional electrical component is electrically coupled to at least one of said at least two electrical components.

25. The combination electrical device as in claim 23, wherein said at least two electrical components further comprise at least one busbar for electrically coupling to said at least one clip.

26. The combination electrical device as in claim 25, wherein said at least two electrical components comprise at least two busbars including at least a first busbar and at least a second busbar wherein said at least one clip is electrically coupled to said at least one first busbar, and wherein said at least one circuit board further comprises at least one wire which connects to said at least one second busbar.

27. The combination electrical device as in claim 23, wherein said at least one additional electrical component is in the form of a light which has an illuminance of at least one foot candle.

28. The combination electrical device as in claim 27, further comprising at least one cover covering said light.

29. The combination electrical device as in claim 28, wherein said cover has a first face that is trapezoidal in shape.

30. The combination electrical device as in claim 29 wherein said cover has a second face that extends substantially perpendicular to said first face.

31. The combination electrical device as in claim 27, further comprising at least one sensor, wherein said at least one sensor comprises a photoresistor.

32. The combination electrical device as in claim 27, further comprising at least one sensor, wherein said at least one sensor comprises a photo transistor.

33. A combination electrical device comprising:

a) a housing in the form of a electrical enclosure, said housing have a body section and a front face;

b) a duplex user accessible interface formed on said front face and comprising at least two electrical components in a duplex form disposed in said housing;

c) at least one light disposed in said housing;

d) at least one translucent cover disposed on and coupled to said front face of said housing and extending substantially flush with said front face of said housing and adjacent to said duplex user accessible interface said at least one translucent cover configured to extend along said front face between each of the electrical components;

e) at least one sensor in communication with said light, and disposed in said housing, wherein said sensor determines an ambient amount of light disposed outside of said housing, and which selectively turns on or off said at least one light based upon a predetermined amount of detected light and wherein said body section of said housing is configured to be installed into a wall mounted electrical enclosure; and f) at least one connection element coupled to said housing and configured to connect to building wiring;

g) at least two receptacles, each having apertures on said front face, wherein said translucent cover is disposed substantially between said apertures;

h) at least one fault circuit interrupter disposed in said housing;

i) at least one test button configured to test said fault circuit interrupter; and j) at least one reset button configured to reset said fault circuit interrupter wherein said test button and said reset button are disposed between said at least two receptacles on said front face.

* * * * *